United States Patent [19]

Suzuki et al.

[11] Patent Number: 5,074,271

[45] Date of Patent: Dec. 24, 1991

[54] FUEL INJECTION RATE CONTROL SYSTEM FOR STARTING TWO-CYCLE ENGINE

[75] Inventors: Kazuo Suzuki, Tokyo; Tomoyuki Hirose; Tsutomu Kimura, both of Isesaki, all of Japan

[73] Assignees: Fuji Heavy Industries Ltd., Tokyo; Japan Electronic Control Systems Co., Ltd., Isesaki, both of Japan

[21] Appl. No.: 603,446

[22] Filed: Oct. 26, 1990

[51] Int. Cl.[5] ..... F02D 41/06

[52] U.S. Cl. ..... 123/491; 123/179.17

[58] Field of Search ..... 123/179 G, 179 L, 491

[56] References Cited

U.S. PATENT DOCUMENTS

| | | | |
|---|---|---|---|
| 4,681,079 | 7/1987 | Kaneta | 123/491 |
| 4,723,523 | 2/1988 | Kataoka et al. | 123/491 |
| 4,735,184 | 4/1988 | Kasanami et al. | 123/491 |
| 4,739,741 | 4/1988 | Iwata et al. | 123/491 |
| 4,747,386 | 5/1988 | Onishi | 123/491 |
| 4,838,230 | 6/1989 | Matsuoka | 123/491 |

FOREIGN PATENT DOCUMENTS 63-255543 10/1988 Japan .

*Primary Examiner*—Willis R. Wolfe

*Attorney, Agent, or Firm*—Foley & Lardner

[57] ABSTRACT

Herein disclosed is a fuel injection rate control system for starting a two-cycle engine having a fuel injection valve, which comprises: means for correcting the starting basic fuel injection rate, which is stored in advance in terms of an engine temperature, in accordance with the cranking engine speed at the enging starting time; and means for performing a correction in accordance with the cranking time period, wherein the improvement comprises, as the means for correcting the starting basic fuel injection rate in accordance with the cranking engine speed: first engine speed correction coefficient setting means for setting a first engine speed at a first start of the engine; means for deciding second later starts of the engine; and second engine speed correction coefficient setting means for setting an engine speed correction coefficient smaller than that of the first engine speed correction coefficient setting means when the second and later starts of the engine are decided by the decision means.

3 Claims, 5 Drawing Sheets

FUEL INJECTION RATE CONTROL SYSTEM FOR STARTING TWO-CYCLE ENGINE

BACKGROUND OF THE INVENTION

1. Field of the Invention

The present invention relates to a two-cycle engine and, more particularly, to a system for controlling the fuel injection rate for starting the two-cycle engine.

2. Description of the Prior Art

The fuel supply system by a carburetor is adopted in some two-cycle engines to be used in a motorcycle or a snowmobile. In this two-cycle engine, the exhaust port is left open in the scavenging stroke so that more or less air-fuel mixture (or fresh air) will pass together with the combustion gases through the cylinder. This raises a defect of low fuel economy.

In order to eliminate this defect, the fuel supply system is being changed from that using the carburetor to an electronic fuel injection system using a fuel injection valve (as disclosed in Japanese Patent Laid-Open No. 63-255543). According to this disclosure, for example, the engine cylinders are equipped at their individual intake manifolds with fuel injection valves which are controlled to inject the fuel simultaneously for all the cylinders.

In the two-cycle engine using such as electronic fuel injection control system, the fuel injection rate for the start is controlled in the following manner.

In order to improve the startability, the fuel injection rate is so determined that it may be slightly higher for the start than for the ordinary run.

At the starting of the engine by an ignition switch, for example, the value computed from the following Equation is outputted at the cranking time:

$$T_{ILN}=T_{ILNTWK}\times K_{LN}\times K_{lt},$$

wherein:

$T_{ILN}$: Injection pulse width for starting;

$T_{ILNTWK}$: Basic injection rate for starting;

$K_{LN}$: engine speed correcting coefficient; and $K_{LT}$: Time correcting coefficient.

The basic injection rate for starting is one which is stored in advance in terms of an engine temperature; the engine speed correcting coefficient which changes with the cranking engine speed; and the time correcting coefficient which changes with the cranking time.

This two-cycle engine may fail to restart (as shown in FIG. 7) in the case where the engine stalls (or is stopped) for some cause after the engine is once started and has completed the explosion. This failure occurs because the fuel is excessively enriched for the demanded injection rate due to the temperature rise in the cylinders and/or the residual fuel in the crankcase.

SUMMARY OF THE INVENTION

The present invention has been conceived in view of the above-specified problem of the prior art and has an object to provide a fuel injection rate control system for starting a two-cycle engine, which is enabled to facilitate its restart and improve its startability by considering a correction coefficient according to the cranking engine speed, so as to prevent the fuel injection rate from being enriched at the restart.

According to the present invention, there is provided, as shown in FIG. 1, a fuel injection rate control system for starting a two-cycle engine having a fuel injection valve, which comprises: means for correcting the starting basic fuel injection rate, which is stored in advance in terms of an engine temperature, in accordance with the cranking engine speed at the engine starting time; and means for performing a correction in accordance with the cranking time period, wherein the improvement comprises, as the means for correcting said starting basic fuel injection rate in accordance with the cranking engine speed: first engine speed correction coefficient setting means for setting a first engine speed at a first start of the engine; means for deciding second later starts of the engine; and second engine speed correction coefficient setting means for setting an engine speed correction coefficient which is smaller than that of said first engine speed correction coefficient setting means when the second and later starts of the engine are decided by said decision means.

With the structure specified above, the first engine speed correction coefficient set by the first engine speed correction coefficient setting means is used at the first start of the engine to compute the fuel injection rate for the start. If the second or later starts of the engine are decided, on the other hand, the first engine speed correction coefficient set by the second engine speed correction coefficient setting means is then used to compute the fuel injection rate for the start.

Even in case, therefore, where the engine is stopped for some cause after it has been started once and has completed the explosion, and is subsequently restarted, the fuel injection rate is not enriched and this can ensure the restart to improve the overall engine startability.

DESCRIPTION OF THE PREFERRED EMBODIMENT

The present invention will be described in the following paragraphs in connection with the embodiment thereof and with reference to the accompanying drawings.

Figure 1:
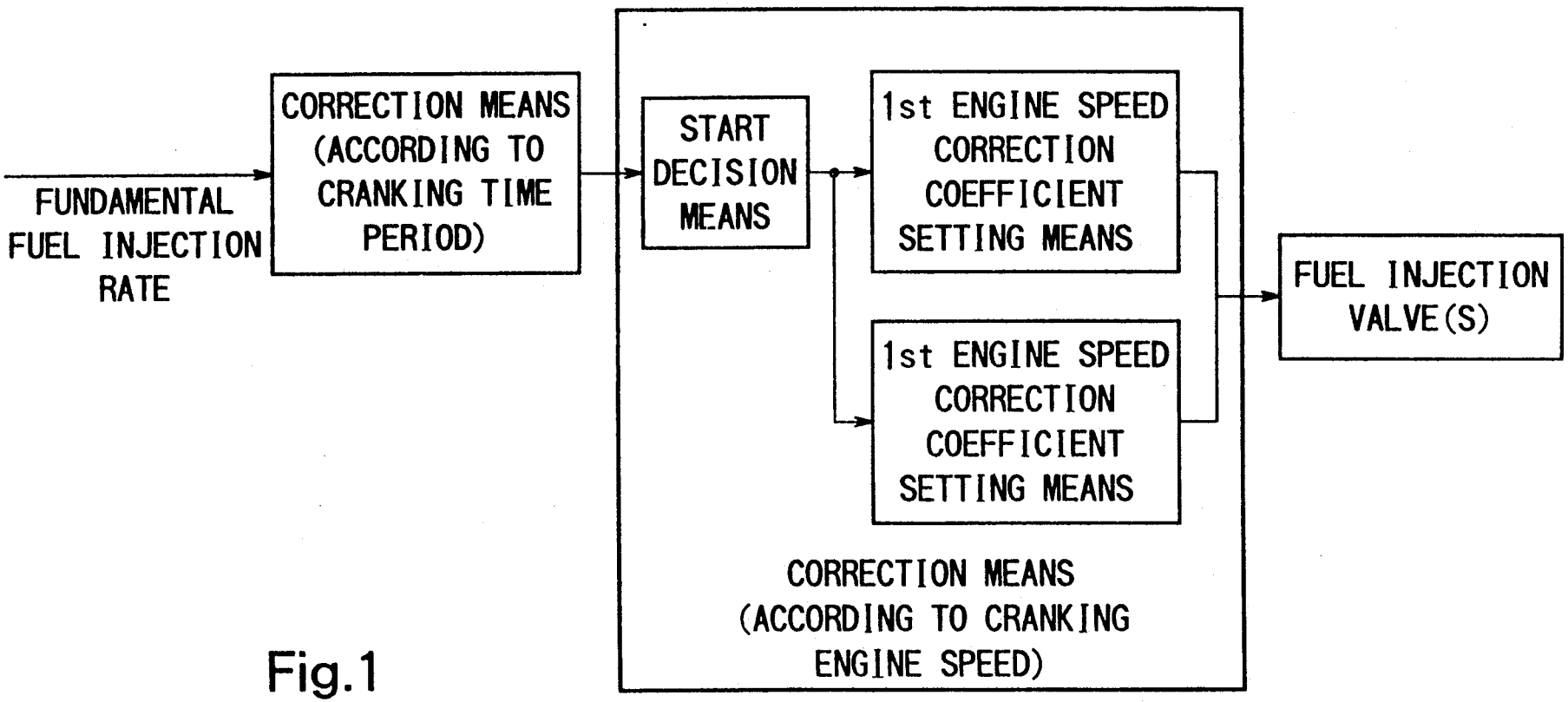
FIG. 1 is a block diagram corresponding to the claim of the present invention.
Figure 2:
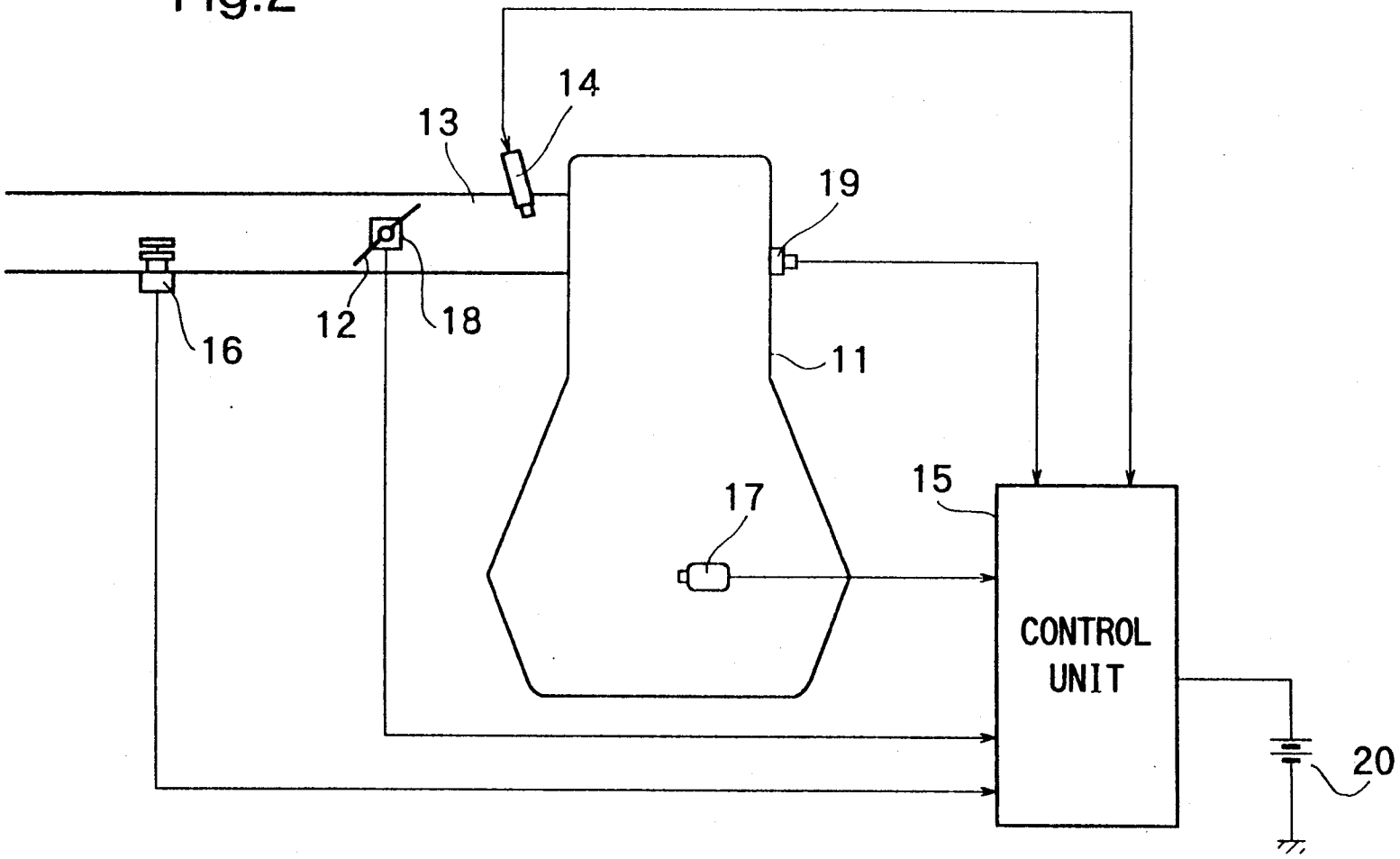
FIG. 2 is a system diagram showing one embodiment of the present invention.

As shown in FIG. 2, a body 11 of a two-cycle engine sucks air from an air cleaner (not shown) through a throttle valve 12 associated with an accelerator and through an intake manifold 13.

The intake manifold 13 has its branches equipped with fuel injection valves 14, respectively, for the engine cylinders. Each fuel injection valve 14 is of an electromagnetic type, in which it is opened and closed when its solenoid is energized and deenergized respectively. In response to a drive pulse signal coming from a control unit 15, the fuel injection valve 14 is opened, with its solenoid energized, to inject the fuel, which is pumped by a fuel pump (not shown) and has its pressure regulated to a predetermined level by a pressure regulator, into the engine body 11.

The control unit 15 processes the output signals, which are fed from a variety of sensors, by its built-in microcomputer to determine a fuel injection rate (or injection time) Ti and an injection timing (or injection type) and accordingly outputs the drive pulse signal to the fuel injection valve 14.

The aforementioned various sensors are exemplified by an air flow meter 16 which is disposed upstream of the throttle valve 12 to output a signal according to an intake air flow rate Q. Another sensor is a crank angle sensor 17 which is built in a distributor (not shown) to output a reference signal at every crank angle of 120 degrees. Thus the number of revolutions N of the engine can be detected by measuring the period of the aforementioned reference signal.

Still another sensor is a throttle sensor 18 of the potentiometer type, which is attached to the throttle valve 12, to output a signal according to the opening $\alpha$ of the throttle valve 12. A further sensor is a water temperature sensor 19 which is attached to the water jacket of the engine body 11, to output a signal according to a cooling water temperature Tw as being representative of the engine temperature.

In the case of the two-cycle engine, on the other hand, the fresh air is supplied to the combustion chamber through a crankcase chamber so that it is influenced directly by the temperature of the crankcase. Therefore, the crankcase temperature may be used as the engine temperature in place of the cooling water temperature.

On the other hand, the control unit 15 is supplied with the voltage of a battery 20 as its operating power or for detecting a supply voltage VB.

Figure 3:
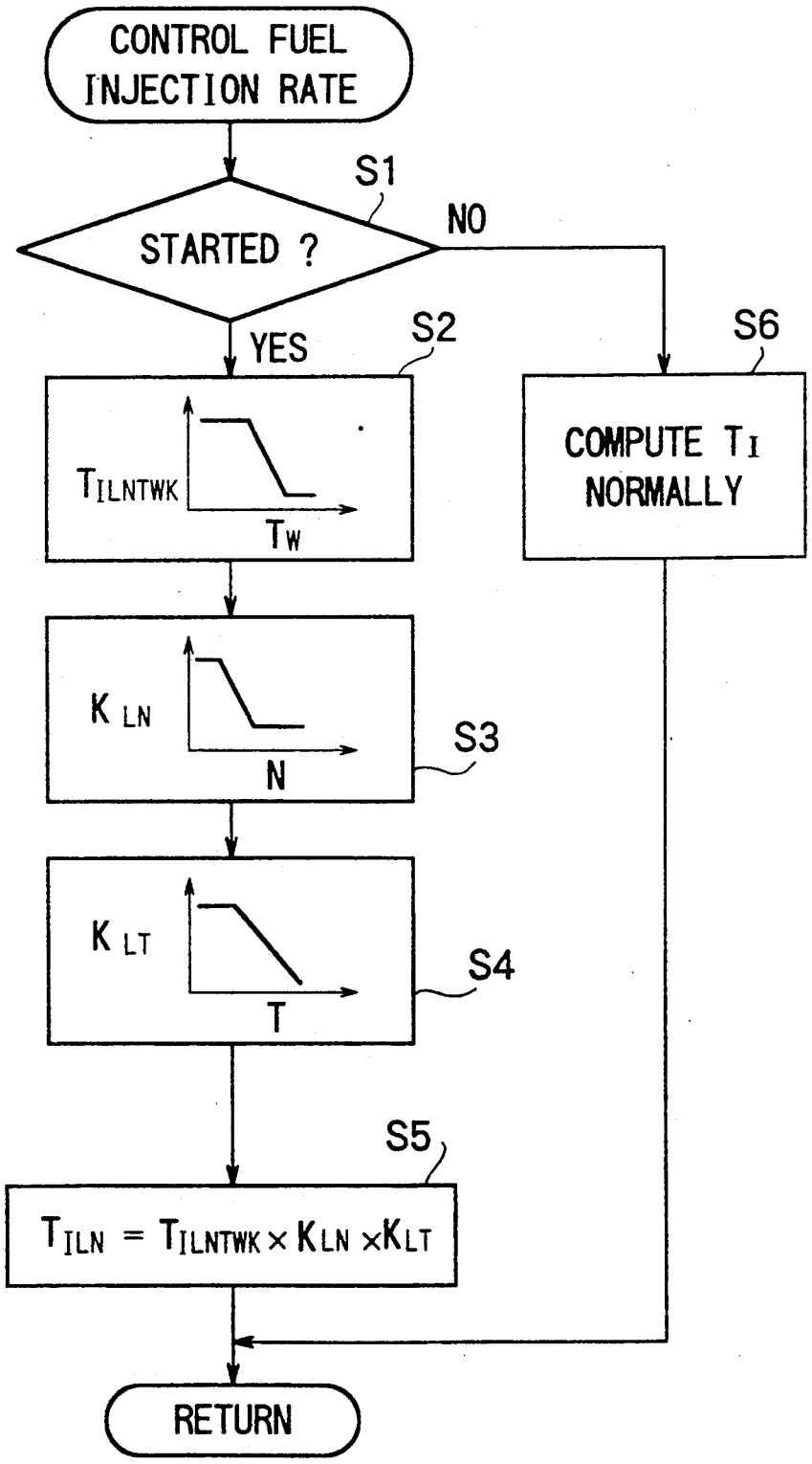
FIG. 3 is a flow chart showing a fuel injection control routine for the start.

Next, the fuel injection rate control for the start of the engine by the microcomputer in the control unit 15 will be described in the following paragraphs with reference to the flow chart of FIG. 3.

At step (as will be abbreviated by "S", as shown) 1, it is decided whether or not the engine is to be started (by the ignition switch).

Figure 4A:
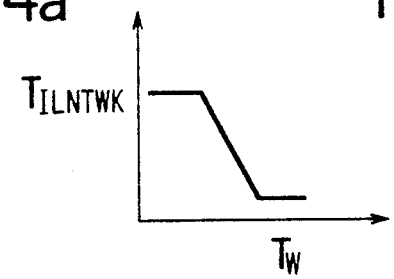
FIGS. 4A to 4D are characteristic diagrams showing correction coefficients corresponding to the starting basic fuel injection rate, the cranking engine speed, and the cranking time period, respectively.

At start, the starting basic fuel injection rate $T_{ILNTWK}$, which is determined, as shown in FIG. 4A, according to the cooling water temperature TW detected by the water temperature sensor 19 in terms of the engine temperature, is retrieved at step 2. At step 3, the engine speed correction coefficient $K_{LN}$, which is determined in advance, as will be described hereinafter with reference to FIG. 4B or 4C, from the engine engine speed, is retrieved.

Figure 4B:
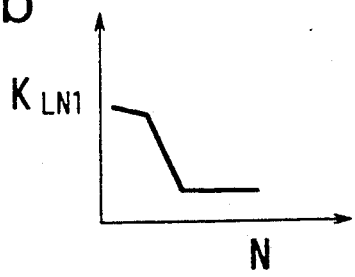
Figure 4C:
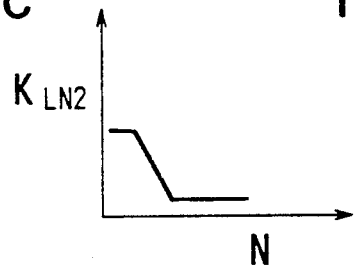
Figure 4D:
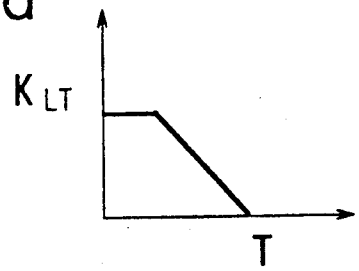

At step 4, a time correction coefficient $K_{LT}$, which is determined, as shown in FIG. 4D, on the basis of and according to a cranking time period T, is retrieved.

At step 5, the injection pulse width $T_{ILN}$ for the start is computed for the controls on the basis of the aforementioned Equation.

In the operations other than the start mode, the routine skips from step 1 to step 6 to compute Ti normally.

Here, the aforementioned control unit 15 is equipped, as means for correcting the starting basic fuel injection rate $T_{ILNTWK}$, with first engine speed correction coefficient setting means for setting a first engine speed at a first start of the engine; means for deciding second later starts of the engine; and second engine speed correction coefficient setting means for setting an engine speed correction coefficient smaller than that of said first engine speed correction coefficient setting means when the second and later starts of the engine are decided by said decision means.

Figure 5:
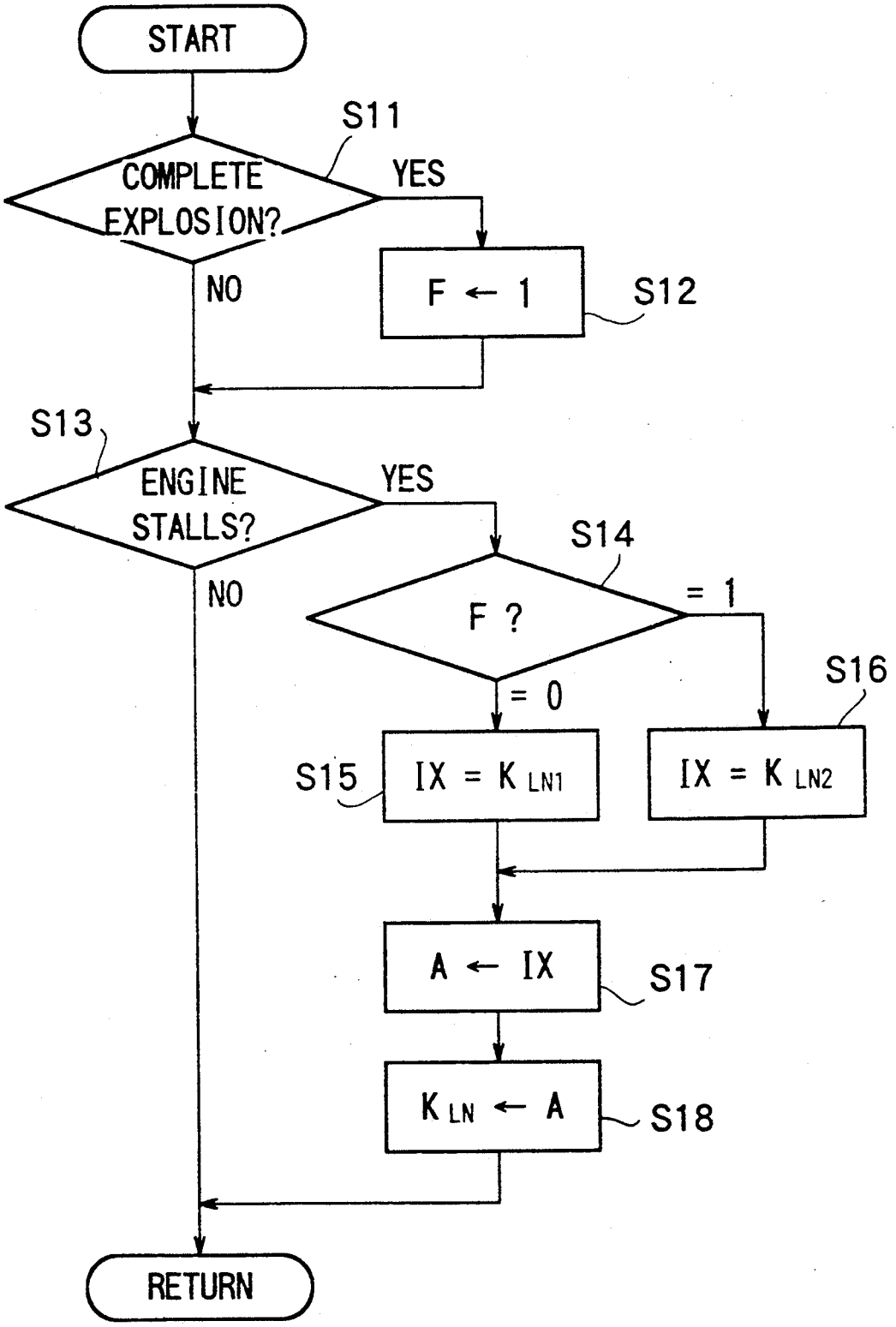
FIG. 5 is a flow chart showing a routine for setting the engine speed correction coefficient.

The operations of the individual means recited above will be described in the following paragraphs on the basis of the routine for setting the engine speed correction coefficients of FIG. 5.

At step 11, the complete explosion is decided to decide the second and later starts of the engine. In other words, it is decided whether or not the engine speed has risen to a preset or higher value.

With this rise, the start decided is the second or later one, and the routine advances to step 12. At step 12, the flag (F) is set to 1, and the routine advances to step 13. If NOT, the start is decided to be the first one, and the routine advances to step 13.

At step 13, it is decided whether or not the engine has stalled (or has been stopped). If NO, the routine is returned to repeat a similar flow.

If YES, the routine advances to step 14, at which it is decided whether or not the flag (F) is set at 1. If NO, the routine advances to step 15 to select the table map of FIG. 4B ($IX \leftarrow K_{LN1}$).

If YES, the routine advances to step 16 to select the table map of FIG. 4C ($IX \leftarrow K_{LN2}$).

AT step 17, the value $K_{LN1}$ or $K_{LN2}$ according to the cranking engine speed is referred to in accordance with the selected table map ($A \leftarrow IX$). At step 18, the referred $K_{LN1}$ or $K_{LN2}$ is set ($K_{LN} \leftarrow A$), and the routine is returned.

Here: step 15 corresponds to the first engine speed correction coefficient setting means of the present invention: step 16 corresponds to the second engine speed correction coefficient setting means; and step 11 corresponds to the means for setting the second and later starts of the engine.

Moreover, the table map of FIG. 4B sets the normal engine speed correction coefficient $K_{LN1}$, and the table map FIG. 4C sets a smaller engine speed correction coefficient $K_{LN2}$ than the engine speed correction coefficient of FIG. 4B.

Figure 6:
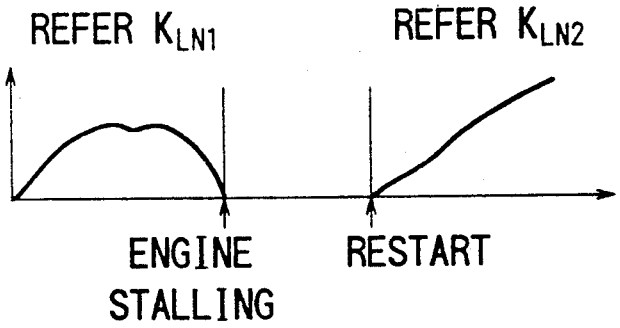
FIG. 6 is a time chart for explaining the effects of the embodiment.
Figure 7:
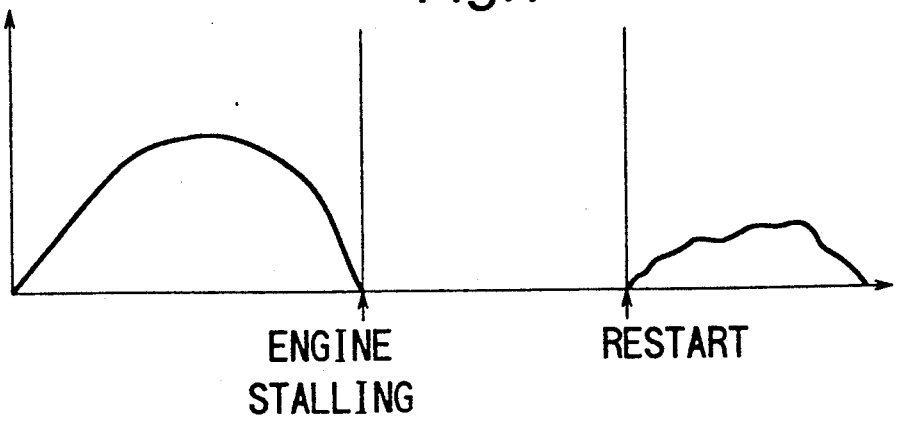
FIG. 7 is a flow chart for explaining the defects of the prior art.

According to the structure thus far described, there are prepared the two table maps of the engine speed correction coefficients according to the cranking engine speed so that the restart may refer to the table map of engine speed correction coefficient $K_{LN2}$ having a smaller value than that of the engine speed correction coefficient $K_{LN1}$ to be used for the first start. Even in the case where the engine is restarted after the engine has stalled for some cause after the start and complete explosion of the engine, the fuel injection rate is not enriched, but the restart can be ensured to improve the engine startability (as shown in FIG. 6).

According to the fuel injection rate control system for starting the two-cycle engine of the present invention, as has been described hereinbefore, there are prepared two table maps of the engine speed correction coefficients according to the cranking engine speed so that the restart may refer to the table map of the engine speed correction coefficient $K_{LN2}$ having a smaller value than that of the engine speed correction coefficient $K_{LN1}$ which is used for the first start. As a result, the fuel injection rate is not enriched, but the restart can be ensured to improve the startability of the engine with practically high utility.

What is claimed is:

1. A fuel injection rate control system for starting a two-cycle engine having a fuel injection valve, comprising: means for correcting the starting basic fuel injection rate, which is stored in advance in terms of an engine temperature, in accordance with the cranking engine speed at the engine starting time; and means for performing a correction in accordance with the cranking time period, wherein the improvement comprises, as the means for correcting said starting basic fuel injection rate in accordance with the cranking engine speed first engine speed correction coefficient setting means for setting a first engine speed at a first start of the engine; means for deciding second later starts of the engine; and second engine speed correction coefficient setting means for setting as engine speed correction coefficient smaller than that of said first engine speed correction coefficient setting means when the second and later starts of the engine are decided by said decision means.

2. A fuel injection rate control system for starting a two-cycle engine as set forth in claim 1, wherein the first engine speed correction coefficient setting means comprises a first engine speed correction coefficient storage means for preliminarily storing a first engine speed correction coefficient corresponding to cranking engine speed, and a first engine speed correction coefficient retrieving means for retrieving the stored first engine speed correction coefficient.

3. A fuel injection rate control system for starting a two-cycle engine as set forth in claim 1, wherein the second engine speed correction coefficient setting means comprises a second engine speed correction coefficient storage means for preliminarily storing a second engine speed correction coefficient corresponding to cranking engine speed, and a second engine speed correction coefficient retrieving means for retrieving the stored second engine speed correction coefficient.

* * * * *